United States Patent [19]

Porter

[11] 4,449,464

[45] May 22, 1984

[54] WALKING FOOT FEED FOR SEWING MACHINES

[76] Inventor: Robert E. Porter, 18 Tally Ho Dr., Hamilton, Mass. 01936

[21] Appl. No.: 435,281

[22] Filed: Oct. 4, 1982

[51] Int. Cl.[3] ..... D05B 27/06

[52] U.S. Cl. ..... 112/311; 112/320

[58] Field of Search ..... 112/311, 314, 320, 323, 112/303

[56] References Cited

U.S. PATENT DOCUMENTS

| | | | |
|---|---|---|---|
| 1,006,827 | 10/1911 | Chauvet et al. . | |
| 1,243,160 | 10/1917 | Grieb . | |
| 2,549,057 | 4/1951 | Chinnici . | |
| 2,967,498 | 1/1961 | Russell et al. . | |
| 3,256,844 | 6/1966 | Chezaud et al. . | |
| 3,530,809 | 9/1970 | Porter . | |
| 3,636,899 | 1/1972 | Crisler . | |
| 3,688,712 | 9/1972 | Edwards | 112/330 |
| 3,995,571 | 12/1976 | Porter . | |
| 4,166,422 | 9/1979 | Porter | 112/311 |
| 4,285,294 | 8/1981 | Aida | 112/311 |

FOREIGN PATENT DOCUMENTS

| | | |
|---|---|---|
| 47-78585 | 7/1972 | Japan . |
| 49-46339 | 4/1974 | Japan . |

*Primary Examiner*—Werner H. Schroeder
*Assistant Examiner*—Andrew M. Falik
*Attorney, Agent, or Firm*—Kenway & Jenney

[57] ABSTRACT

A walking foot top feed for a sewing machine in which a walking foot is supported on a beam and a presser foot is supported on an arm, an independent beam being connected to both the presser foot arm and to the walking foot beam and a source of power being connected to the independent beam, the independent beam transferring motion from the source to the walking foot beam and to the presser foot arm to cause out-of-phase movement of the walking foot and the presser foot.

9 Claims, 4 Drawing Figures

WALKING FOOT FEED FOR SEWING MACHINES

This invention relates in general to top feeds for sewing machines and in particular to a top feed of the walking-foot variety.

From a very early date, it has been the practice to provide some form of feeding mechanism in sewing machines. In practically every machine, whether of the industrial or domestic type, a so-called lower feed dog is mounted beneath the needle plate. The lower feed dog has a serrated upper surface which extends through a suitable aperture formed in the needle plate. Mounted above the aperture is a presser foot, generally having a smooth lower surface juxtaposed relative to the serrated upper surface of the lower feed dog. The lower feed dog goes through a cyclical motion and material being sewn is pressed against the lower feed dog by the presser foot during horizontal travel of the lower feed dog in a direction away from the operator. The material is thus advanced, permitting the needle to make consecutive spaced stitches in the material as the needle goes through its reciprocal motion.

Over the years, various improvements in feeding materials in sewing machines have been made. One early improvement was the addition of a so-called differential lower feed dog, the motion of which relative to the main lower feed dog is such as to prevent puckering of the material. More recently, especially for use in overlock and safety stitch sewing machines, there have been developed a number of top feeds. These top feeds are generally designed to include a top feed dog which is synchronized in its operation with the lower feed dog. Examples of such top feed mechanisms are found in U.S. Pat. Nos. 3,530,809, 3,995,571 and 4,166,422 issued to the applicant in the present application.

The top feeds of the type disclosed in the above-identified patents have proven very useful and have met with wide acceptance in the field. This is especially true in the case of automated sewing operations where the same operation is carried out repetitively with the same materials. However, where it is desired to feed many different types and thicknesses of material through a sewing machine, there has been available a top feed mechanism known as a walking-foot top feed. Generally, walking-foot top feeds have a serrated lower surface but are otherwise similar to the normal presser foot. The second foot "walks" or oscillates in out-of-phase vertical relationship to the presser foot and also travels horizontally. In other words, when the presser foot is in contact with the top surface of the material being sewn and holding it against the needle plate, the auxiliary or walking foot is lifted from the material. It then comes forward to grip the top of the material while the lower feed dog grips the bottom of the material and the needle and presser foot are lifted from the material. The combined action of the presser foot and the walking foot resembles more or less the walking action of a human being which, of course, gives rise to the name applied to the mechanism.

The only walking-foot feeding mechanisms available at this time are generally operated by separate drive mechanisms and two drive shafts are required, one for operating the lower feed dog and a second for operating the oscillating upper walking foot. The complexity and expense of such structures, not to mention their constant need for adjustment, have limited the market and acceptability of such machines.

The primary object of the present invention is, therefore, a walking-foot top feed for sewing machines which is operable with any type of material which can be sewn.

A further object of the present invention is a walking-foot feed mechanism capable of handling materials of widely different thicknesses.

A still further object of the present invention is a walking-foot feed mechanism for a sewing machine which does not require complicated and multiple drive systems.

Another object of the present invention is to reduce the cost and complexity of walking-foot feed mechanisms for sewing machines.

SUMMARY OF THE INVENTION

Generally, the present invention involves a drive system and linkage which permits the use of existing drive components of conventional machines to be adapted to the driving of a walking foot. No separate drive system or multiple drive shafts are involved. Lifting of the walking foot as required is effected by the main drive system which also, of course, provides the needle drive and others, such as the knife arm drive. Suitable linkages are provided to insure the feeding action of the walking foot in phase with the lower feed dog and out of phase with the presser foot. For a better understanding of the present invention together with other objects, features and advantages, reference should be made to the following specification which should be read in conjunction with the appended drawings.

BRIEF DESCRIPTION OF DRAWINGS

The four figures of the drawing are side perspective views of a sewing machine with covers removed to permit viewing of the walking foot and its drive mechanism. In the drawing.

DETAILED DESCRIPTION OF INVENTION

Figure 1:
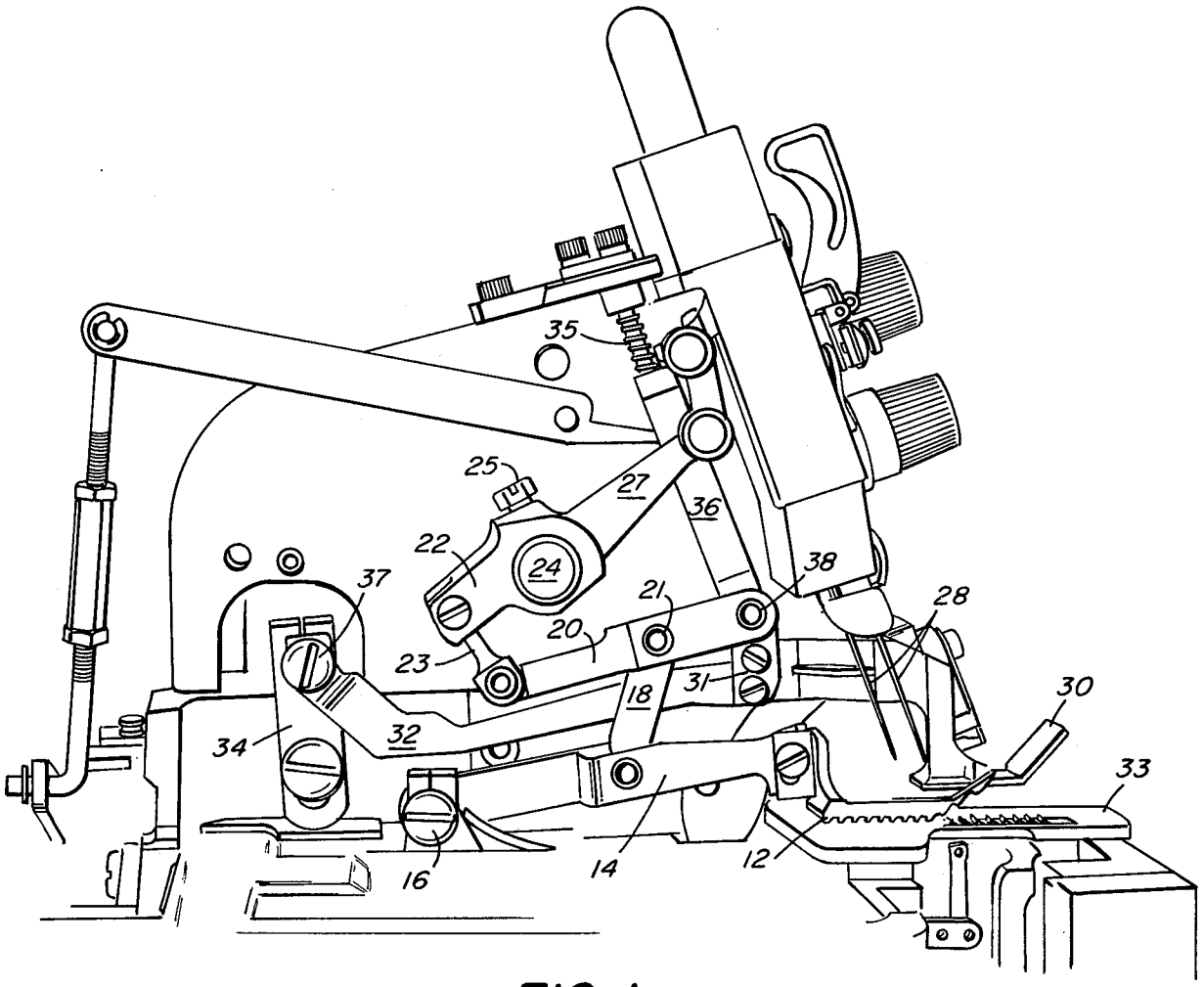
FIG. 1 illustrates the portion of the cycle where the needles are withdrawn, the pressure foot is raised, and the walking foot is down in the feeding position to grip material between the lower surface of the walking foot and the upper surface of the lower feed dog.

In FIG. 1, there may be seen a walking foot 12 supported at the front end of a beam 14 in a material feeding position. The opposite end of the beam 14 is pivotally connected at 16 to the reciprocating drive system for the lower feed dog (not shown in detail). Approximately midway of its length, the beam 14 is connected by a short link 18 to a second independent beam 20. The independent beam 20 at its back end is linked to a crank 22 by means of an arm 23. The crank 22 is mounted on a drive shaft 24 and held in position by means of a lock screw 25. The drive shaft 24 is actually a top drive shaft and is the source of drive for several operations including the needle system and the knife arm. An end 27 of the crank may be seen to be linked to the needle drive and provides it with reciprocatory motion.

A presser foot 30 is mounted at the end of a presser arm 32 which is pivotally attached to a standard 34 as at pivot 37. The standard 34 can be moved angularly and locked in a desired position to determine the horizontal position of the presser foot 30 over a short range.

As has been noted, FIG. 1 illustrates the mechanism in a feeding position. Both the needles 28 and the presser foot 30 are raised to their upper positions. The walking foot 12 is in its lowermost position for contacting the top surface of materials being sewn. No materials are shown to permit a clear view of the system. Although it is not clearly visible in FIG. 1, the lower feed dog is also in a position to contact the lower surface of material, having reached its uppermost position.

With the working elements in the positions described, the crank end 27 is fully rotated in a counterclockwise direction lifting the needles 28. The opposite end 22 of the crank arm by reason of its counterclockwise rotation has forced the arm 23 down. One end of the beam 14 fixed against downward motion by reason of the walking foot 12 being at its lowermost position against the needle plate 33. The opposite end of the beam 14 is also immovable downwardly by reason of its pivotal connection 16. Being connected by the link 18 to the immovable beam 14, the independent beam 20 is forced to rotate about the pivotal point 21 as a first fulcrum in response to the downward movement of the arm 23. This counterclockwise rotation of the beam 20 lifts the second link 31 which is pivotally attached to the presser arm 32. The presser foot 30 is thus raised from the needle plate 33 against the pressure exerted by the spring 35 acting through the bar 36 against the end of the independent beam 20.

Figure 2:
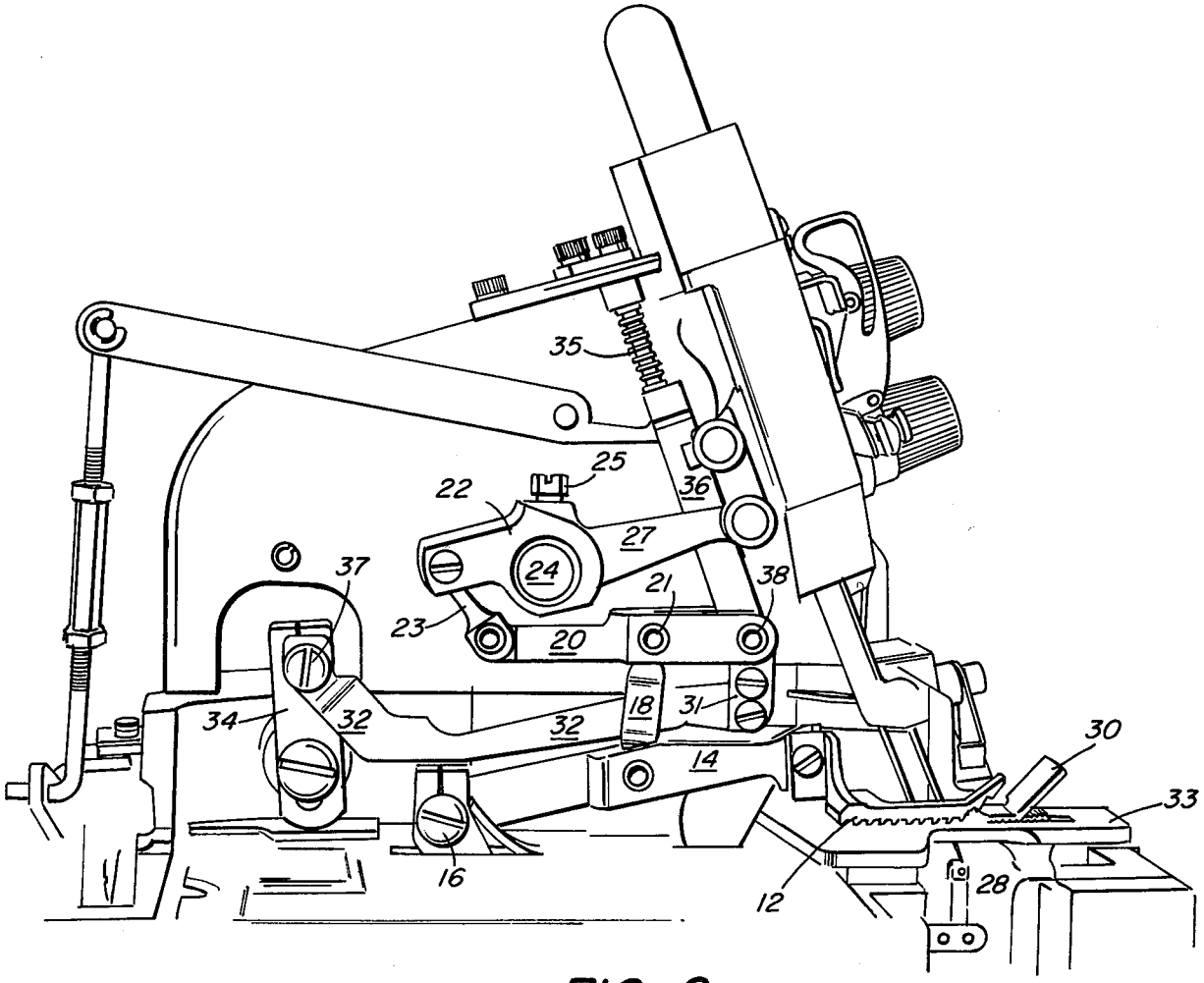
FIG. 2 illustrates the mechanism with the needles about one-half way in their downward travel, the presser foot down in a position to contact the material being sewn, the walking foot lifting and lower feed dog dropping as feeding ends.

In FIG. 2, as noted above, the needles 28 are shown in a position half-way down their travel. The presser foot 30 is at the bottom of its travel; the walking foot 12 has lifted from the needle plate and the lower feed dog has dropped beneath the needle plate.

The various new positions of the working components have come about by reason of the rotation of the drive shaft 24 in a clockwise direction, driving the needles downwardly in response to the motion of the right-hand crank end 27. The left-hand crank end 22 has lifted the left-hand end of the beam 20 by reason of the connection of the arm 23. Pivoting of the independent beam 20 about the point 21 in a clockwise direction has caused the presser foot 30 to be lowered by reason of the connection between the beam 20 and the presser arm 32 provided by the link 31. Downward movement of the presser arm 32 is assured by the expanding action of the spring 35 acting through the bar 36 and the second link 31.

Continued clockwise rotation of the crank arm end 27 raises the left-hand end of the beam 20 further. Because the presser foot 30 can descend no further by reason of its contact with the needle plate 33 and its fixed pivotal connection at the point 37, a new second fulcrum point is established at the pivotal connection 38. The link 18 now lifts the walking-foot beam 14 which pivots about the point 16 at its left-hand end, causing the walking foot 12 to rise from the needle plate.

Figure 3:
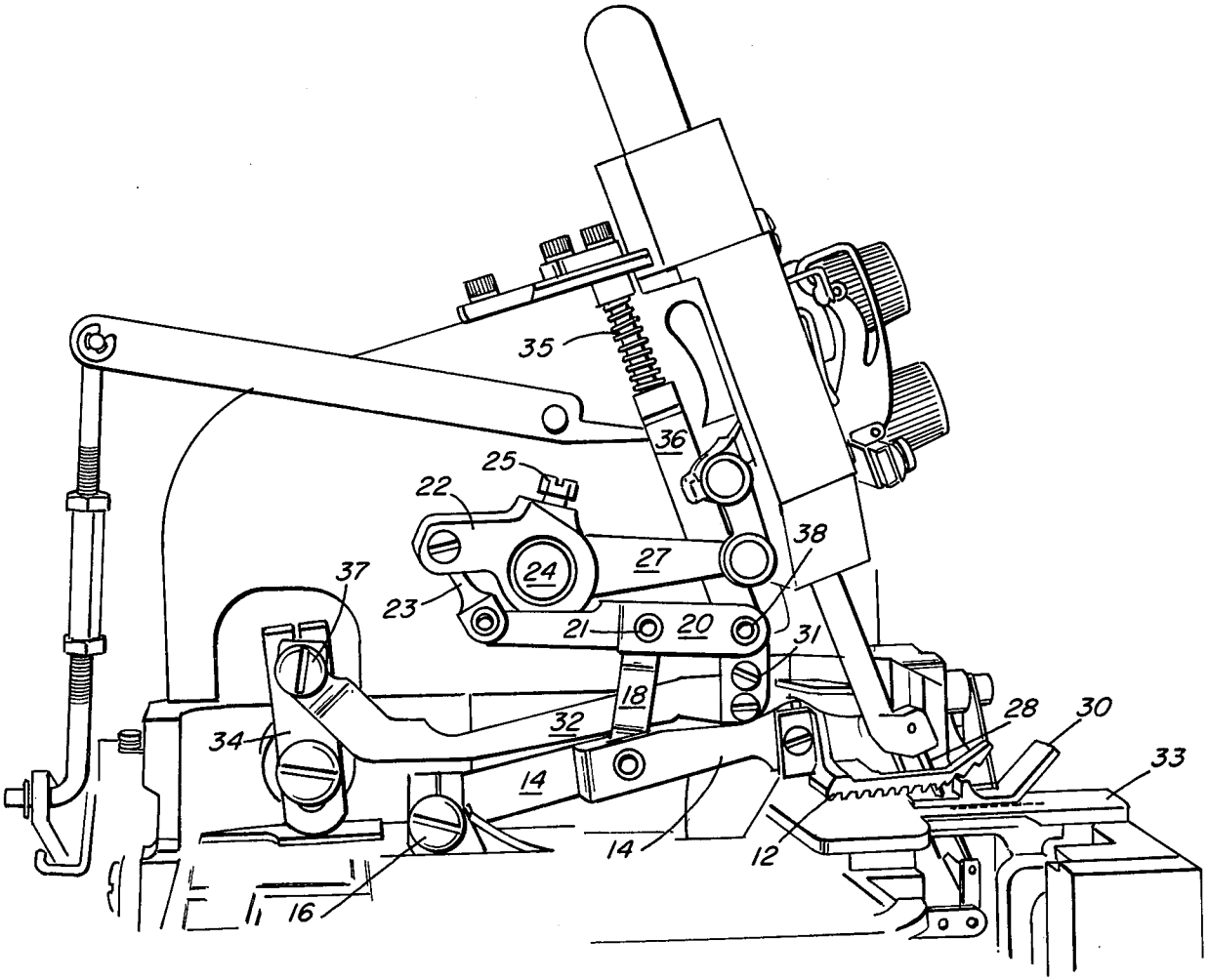
FIG. 3 shows the needles in full down position with the presser foot still down in a position to contact the material, the walking foot being fully raised and returning with the lower feed dog being fully lowered.

As noted above, FIG. 3 illustrates the situation where the needles 28 are at their full downward excursion. The presser foot 30 is in contact with the needle plate, the walking foot 12 is fully raised and the lower feed dog is fully lowered.

This position of the working elements comes about as a result of the following sequence of events. The crank end 27 has rotated fully clockwise as has the beam 20 about the pivot point 21. The beam 20 maintains the presser foot fully down by reason of the second link 31 between the right-hand end of the beam 20 and the presser arm 32. At the same time, the walking foot 12 is at its full height out of contact with the throat plate 33.

Figure 4:
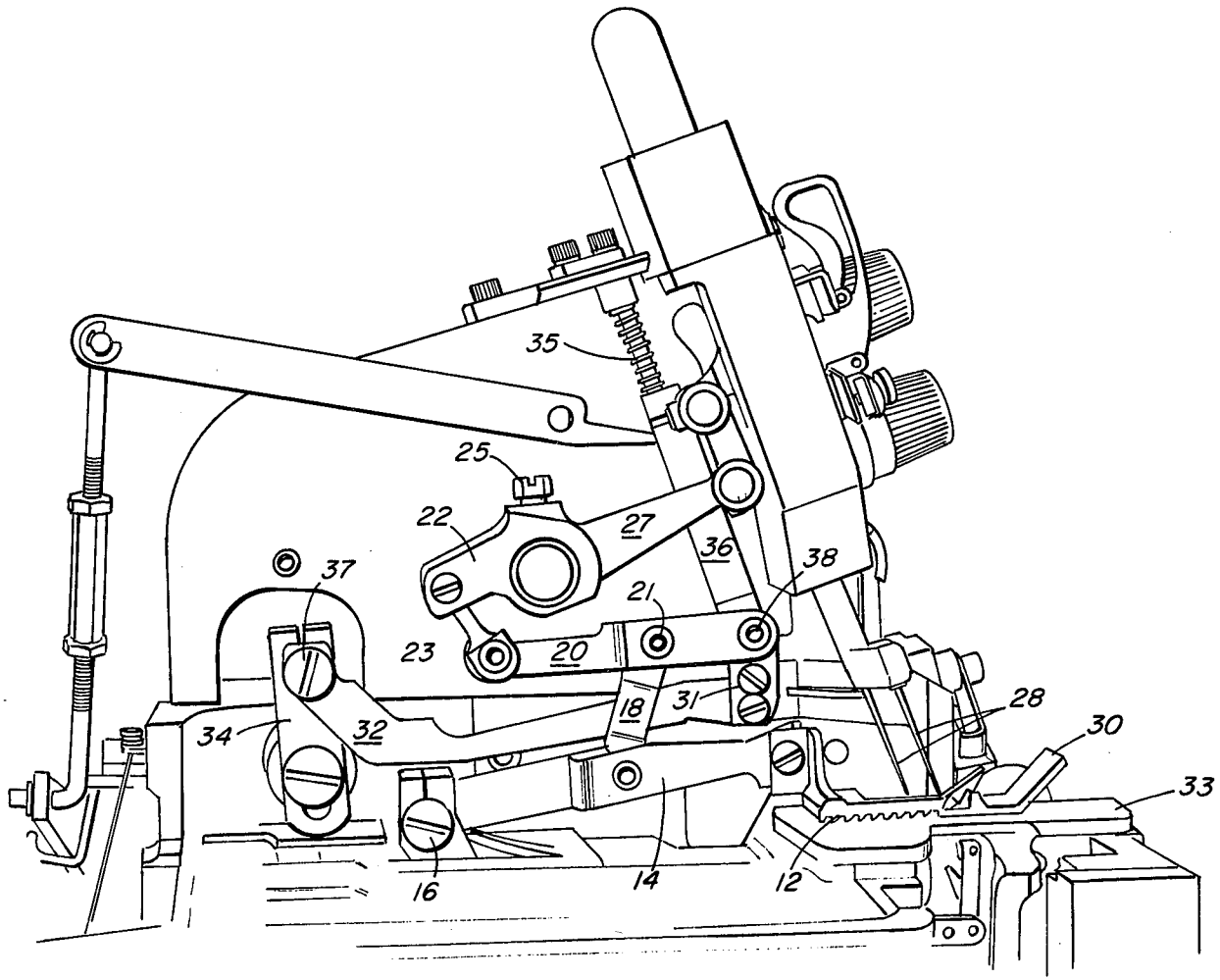
FIG. 4 shows the needles about one-half way in their return upward travel, the presser foot also rising part way in its travel, the walking foot moving downwardly to begin feeding the material, the lower feed dog rising to contact the lower surface of the material.

Next, however, as shown in FIG. 4, the crank arm end 27 commences its counterclockwise rotation, the arm 23 in its downward travel causes the beam 20 to pivot about the point 38. That downward motion is conveyed by the link 18 to the walking-foot beam 14 which pivots about the point 16 to bring the walking foot 12 down toward the needle plate. At the same time, the lower feed dog drive system connection at 16 reaches its full forward position and the walking foot 12 is at the point where its feeding motion can commence. Further counterclockwise rotation of the crank arm end 22 is ineffective to cause further rotation of the beam 14 because of the contact of the walking foot 12 with the needle plate 33. A fulcrum for rotation of the beam 20 is re-established at the pivot point 21. As a result, the pivot connection 38 is lifted and the presser arm 32 rises to lift the presser foot 30 from the needle plate, compressing the spring 35. Further counterclockwise rotation of the crank arm end 22 leads to the phase of operation (feeding) described above in connection with FIG. 1.

Although two needles are shown in the preferred embodiment, there can of course be one or a plurality of needles used. Also, although reference has been made to the out-of-phase operation of the walking foot and presser foot, the walking foot has a horizontal component of motion for its feeding function whereas the presser foot has only a near-vertical reciprocal motion.

What has been shown and described is a preferred embodiment of the invention. The linking of presser foot arm and walking foot beam is believed to be an important feature which may be achieved with other mechanical components believed to be within the purview of the claims.

What is claimed is:

1. In a sewing machine having a source of driving power, a presser foot and a walking foot top feed, the combination of a beam supporting said walking foot top feed, an arm supporting said presser foot, an independent pivoting beam, means pivotally connecting said independent beam to said arm and to said walking-foot supporting beam and means connecting said independent beam to said source of driving power to cause said walking-foot top feed to travel in a substantially out-of-phase relationship with said presser foot.

2. In a sewing machine as defined in claim 1, the combination wherein said source of driving power for said independent beam includes means pivotally connecting said source to an end of said independent beam, said arm being connected at a first point along said independent beam and said walking-foot beam being connected at a second point along said independent beam whereby motion is transferred by said independent beam to cause said walking foot top feed to travel in out-of-phase relationship to said presser foot.

3. In a sewing machine as defined in claim 2 which includes a needle plate, the combination wherein contact between said walking-foot top feed and said needle plate causes the fulcrum of said independent beam to shift from one to the other of said first and second points.

4. In a sewing machine as defined in claim 3, the combination wherein said support arm is pivotable about a fixed point remote from said presser foot and said walking-foot top feed is pivotable about a movable point remote from said walking-foot top feed, said movable point providing generally horizontal motion to said walking-foot top feed.

5. In a sewing machine as defined in claim 1, the combination which includes a needle plate, said presser foot arm being pivoted at one end from a fixed point, said presser foot being fixed to the other end of said arm, resilient means normally urging said arm toward said needle plate, said walking-foot beam being pivoted at one end from a generally horizontal movable point, said walking-foot top feed being fixed to the other end of said beam, an independent beam linked at one point to said presser foot arm and at a second point to said walking-foot beam, means connected from said source of driving power to one end of said independent beam for rotating said independent beam alternately about each of said two points as fulcrums periodically to raise said presser foot against the pressure of said resilient means as said walking-foot top feed contacts said needle plate.

6. In a sewing machine as defined in claim 5, the combination wherein said fixed point is adjustably mounted on said sewing machine whereby the horizontal position of said presser foot relative to said needle plate may be adjusted.

7. In a sewing machine as defined in claim 6, the combination wherein said one point on said independent beam connected to said presser foot arm is adjacent the other end of said independent beam and said second point on said independent beam connected to said walking-foot beam is approximately midway along the length of said independent beam.

8. In a sewing machine as defined in claim 7, the combination wherein said presser foot is raised as said walking-foot top feed contacts said needle plate and said walking-foot top feed is raised as said presser foot contacts said needle plate.

9. In a sewing machine as defined in claim 5, the combination wherein said means connected to one end of said independent beam for rotating said independent beam includes a drive shaft turning clockwise and counterclockwise alternately and a crank mounted on said drive shaft and linked to said one end of said independent beam.

* * * * *